United States Patent [19]

Carter

[11] Patent Number: 4,726,200

[45] Date of Patent: Feb. 23, 1988

[54] COMBINATION RING PENDENT

[76] Inventor: Nick P. Carter, P.O. Box 66471, Baton Rouge, La. 70896

[21] Appl. No.: 884,018

[22] Filed: Jul. 10, 1986

[51] Int. Cl.[4] ..... A44C 9/00; A44C 15/00

[52] U.S. Cl. ..... 63/15; 63/31

[58] Field of Search ..... 63/1, 2, 15, 31, 1 R; D11/79

[56] References Cited

U.S. PATENT DOCUMENTS

| | | | |
|---|---|---|---|
| D. 272,609 | 2/1984 | Ofiesh | D11/79 |
| 1,548,645 | 8/1925 | Akeson | 63/15 |
| 1,920,875 | 8/1933 | Miskind | 63/15 |
| 3,192,737 | 7/1965 | Schechter | 63/1 R |
| 3,959,989 | 6/1976 | Bhandia | 63/31 |
| 4,165,621 | 8/1979 | Gould | 63/15 |
| 4,220,017 | 9/1980 | Freeman | 63/15 |

FOREIGN PATENT DOCUMENTS

| | | | |
|---|---|---|---|
| 699074 | 12/1930 | France | 63/1 R |
| 766125 | 4/1934 | France | 63/15 |
| 333448 | 8/1930 | United Kingdom | 63/1 R |

*Primary Examiner*—Richard J. Johnson

[57] ABSTRACT

A convertible ring, pendent comprising of an ornamental piece of jewelry, which may be configured as a ring or pendent, depending on the owner's needs. As a ring, the gemstone mounting or other ornamental centerpiece is held by a unique locking mechanism, in the plane perpendicular to the semi-split shank. Conversion between the two states is accomplished by movement about a fixed pin which is at the top of the semi-split shank.

1 Claim, 12 Drawing Figures

VIEW IN DIRECTION OF ARROW A

COMBINATION RING PENDENT

BACKGROUND OF THE INVENTION

This invention relates generally to jewelry and more particularly to an ornamental article interconvertible from a ring to a pendant.

Pendants which allow a variety of centerpieces are known in the prior art. French Pat. No. 699,074 is such a device in which a tongue-and-groove mechanism allows the centerpiece to be removed or inserted easily.

Finger rings in the prior art have been devised so as to offer a convenient means of altering the diameter of the shank portion as in U.S. Pat. Nos. 1,548,645 and 3,959,989.

Convertible rings also exist in the prior art. U.S. Pat. No. 4,165,621 may be converted for use as a lapel pin; U.S. Pat. No. 1,920,875 may be converted for use as a jewelry clip. Another example is U.S. Pat. No. 1,548,645 which allows the orientation of the gem mount portion to be changed relative to the plane of the ring band portion.

Numerous examples of ring-pendants may also be found in the prior art. Certain of these, as in U.S. Pat. No. 3,192,737, require that the centerpiece be detached from the ring band prior to its use as a pendant. Another form of ring-pendant, as in U.S. Pat. Nos. D. 272,609, 4,220,017 and 333,448, the gem portion is pivotally mounted between the ends of a generally U-shaped ring band, as is the case in the present invention. However, these devices utilize the palm side of the ring band as the point of insertion for a chain when the device is used as a pendant. Because this is the portion of the ring band which is generally altered when changing the diameter of the ring band, enlarging or reducing the ring band is made more difficult for the craftsman by necessitating the realignment and possible reconstruction of the holes intended for insertion of the chain.

Convertible ring-pendants of the prior art which do not require detachment of the ornamental centerpiece for use as a pendant typically employ a conversion mechanism whereby the ornamental centerpiece hangs at the base of the ring band portion when the device is configured as a pendant, as in French Pat. No. 766,125.

SUMMARY OF THE INVENTION

In general, the present invention provides an interconvertible ring-pendant, comprising: (a) an annular member including an open end; (b) a transverse member spanning the open end of the annular member and connected to the annular member; (c) an ornamental centerpiece, rotatably suspended from the transverse member; and (d) means for limiting the arc defined by rotation of the centerpiece about the axis of the transverse member to about 180 degrees.

The ring-pendant includes a ring-band portion which is generally U-shaped, the ends of the U being constructed with small circular-section channels to guide the ornamental centerpiece in either direction of the conversion process. A small pin is permanently fixed between the ends of the U-shaped member. The centerpiece is suspended on this pin and is equipped with two small protruding tabs which will slide into the channels of the ring band during conversion, allowing for rapid and simple change from finger ring to pendant. The ring band is provided with a pair of openings at the ends of the U to receive a chain therethrough for use as a pendant. Thus, the centerpiece hangs within the ring portion when the invention is used as a pendant, rather than hanging at the base of the ring band as is common in the prior art.

It should be noted that this centerpiece may bear on its upper and lower surfaces any design which may appeal to the wearer; moreover, the centerpiece may comprise only a precious metal which may be decorated to the wearer's specifications or it may comprise gem mounts on one or both surfaces so as to allow different gems to be displayed while in the pendant configuration. No specific design is assumed; it is only the casing of the centerpiece which is of importance to the operation of the present invention.

The primary object of this invention is to provide a means of converting easily and quickly between finger ring and pendant without adversely affecting the condition of the conversion mechanism. Mechanisms which are based on frictional or resilient forces as found in the prior art are susceptible to loss of efficiency as a pendant due to wearing down of mechanical parts. This is particularly true when the item is constructed of precious metals which are well known to have a soft malleable nature. Because the present invention does not rely on such forces to restrain motion of the centerpiece, increased longevity of the device is easily obtained assuming similar usage of the devices.

Another object of this invention is to increase the design-level contribution of the ring band when the device is configured as a pendant. Devices of the prior art typically suspend the centerpiece at the base of the ring band, producing the illusion of an amulet. Because the present invention suspends the centerpiece at the top of the ring band between the ends of the band, each configuration assumes a more unique appearance.

Yet another object of this invention is to allow the ring band to be altered in the traditional manner to which craftsmen of the jewelry trade are accustomed. Whereas in the prior art the palm side of the ring band has been used as the location of holes intended for insertion of a chain, and whereas such use of the palm side of the ring band complicates the process of altering the diameter of the ring band, the present invention uses instead the top side of the ring band for such insertion of a chain, thereby relieving the palm side of this function and permitting the jeweler to alter the diameter of the ring band as required in the usual fashion.

DESCRIPTION OF THE PREFERRED EMBODIMENT

Figure 1:
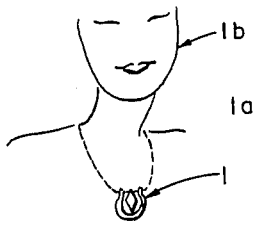
FIG. 1 is a schematic representation of the present invention in pendant configuration.
Figure 2:
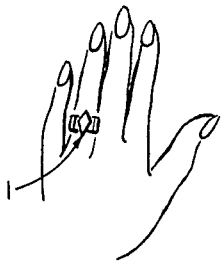
FIG. 2 is a schematic representation of the present invention in finger-ring configuration.
Figure 3:
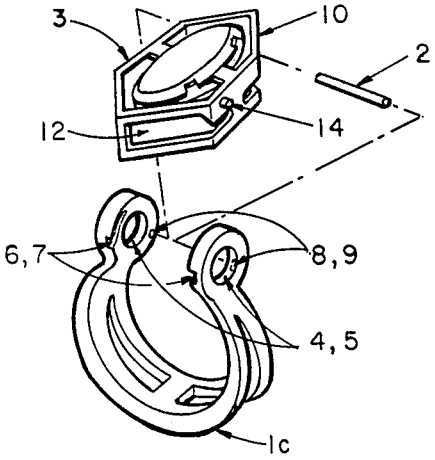
FIG. 3 is an exploded perspective view of an interconvertible ring-pendant made in accordance with the principles of the present invention.
Figure 4:
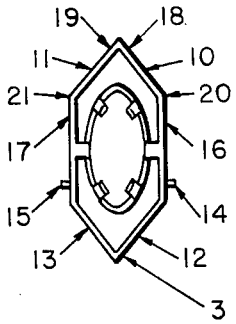
FIG. 4 is a front elevation of an ornamental centerpiece made in accordance with the principles of the present invention.
Figure 5:
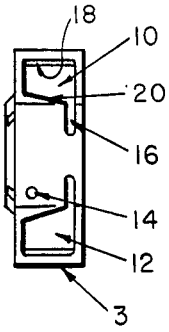
FIG. 5 is a side elevation of the same ornamental centerpiece as shown in FIG. 4.
Figure 6:
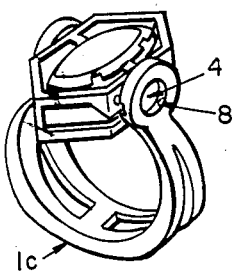
FIG. 6 is an isometric view of an interconvertible ring-pendant in the finger-ring configuration made in accordance with the principles of the present invention.
Figure 7:
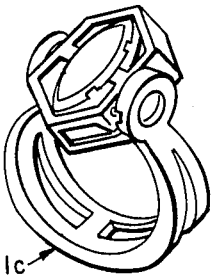
FIGS. 7 and 8 are isometric views of intermediate positions achieved in the conversion between finger-ring and pendant configurations.
Figure 8:
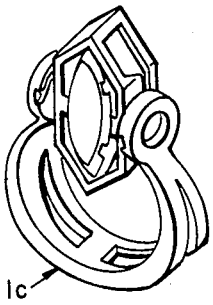
Figure 9:
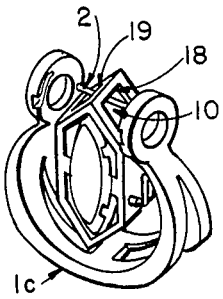
FIG. 9 is an isometric view of the present invention in the pendant configuration.

Referring now to the drawings, FIG. 1 illustrates the wearing in a pendant configuration of an interconvertible ring-pendant 1 made in accordance with the principles of the present invention. The combination of the interconvertible ring-pendant 1 and person 1*a* is designated generally as 1*b*. FIG. 2 illustrates the wearing of the interconvertible ring-pendant 1 in the finger-ring configuration in FIG. 2. The interconvertible ring-pendant 1 is shown in exploded perspective in FIG. 3. The interconvertible ring-pendant 1 comprises a ring-band 1*c*, a transverse pin 2 and an ornamental centerpiece 3. The ring-band 1*c* is generally U-shaped, the ends of the U including a pair of holes 4 and 5 to receive a chain (not shown) therethrough for use as a pendant. The ring-band 1*c* includes a pair of arcuate-section channels 6 and 7 allowing for rotation of centerpiece 3 about pin 2 into the finger-ring configuration. Pin 2 is permanently fixed between the ends of ring-band 1*c* at points 8 and 9, providing an axis of rotation to be used in transferring the interconvertible ring-pendant from one configuration to the other. Reference is now made to FIGS. 4 and 5 which show front and side views, respectively, of the ornamental centerpiece 3. The centerpiece 3 includes at least two pairs of holes 10 and 11, and 12 and 13. Holes 10 and 12 are also visible in FIG. 3. Before being attached to ring-band 1*c* of FIG. 3, pin 2 is inserted through the uppermost pair of holes, 10 and 11. The lower pair of holes, 12 and 13, provide visual balance and prevent excessive weight in the lower half of the centerpiece 3. Thus, when pin 2 is attached to ring-band 1*c* the pendant configuration results as shown in FIG. 9. Referring again to FIG. 4, centerpiece 3 includes a pair of tabs 14 and 15. During conversion to the finger-ring configuration, tabs 14 and 15 slide into circular-section channels 6 and 7, allowing centerpiece 3 to rotate through 90° into a plane perpendicular to the ring-band 1*c*. After rotation through 90°, pin 2 slides into notches 16 and 17, thereby holding centerpiece 3 stationary with respect to band 1*c*. This motion completes the conversion to the finger-ring configuration, shown in FIG. 6. FIGS. 6, 7, 8 and 9 illustrate the steps required to convert from the finger-ring configuration to the pendant configuration. FIG. 6 shows the finger-ring configuration. As shown in FIG. 7, slight downward pressure applied at the base of centerpiece 3 causes rotation of the centerpiece, said motion being guided by tabs 14 and 15 which follow circular-section channels 6 and 7. When tabs 14 and 15 have rotated a full 90°, centerpiece 3 will be in a plane parallel to that of band 1*c*, as shown in FIG. 8. From this point, centerpiece 3 may easily be lowered so that points 18 and 19 of the centerpiece 3, inside holes 10 and 11, rest on pin 2. Centerpiece 3 is now in the required position for the pendant configuration, illustrated in FIG. 9. Insertion of a chain (not shown) through holes 4 and 5 allow the interconvertible ring-pendant to be worn as a pendant. Reversal of these steps restores the interconvertible ring-pendant to the finger-ring configuration.

For detailed analysis of the locking mechanism, reference is now made to FIGS. 4, 5, 10 and 11. When the interconvertible ring-pendant is configured in the pendant mode, as in FIG. 9, pin 2 supports centerpiece 3 at points 18 and 19, whereby the centerpiece 3 is free to swing on pin 2 but is not detachable from ring-band 1*c*. Tabs 14 and 15 on the sides of centerpiece 3, together with holes 10 and 11 on the centerpiece and channels 6 and 7 on ring band 1, constitute the locking mechanism.

Conversion to the finger-ring configuration is the reverse of the conversion to the pendant configuration. Beginning with the pendant configuration as in FIG. 9, centerpiece 3 is moved vertically upwards as in FIG. 8, until pin 2 contacts points 20 and 21 in holes 10 and 11, these points being in a vertical line with points 18 and 19, respectively. Tabs 14 and 15 are adjusted so as to align with the openings of channels 6 and 7. Centerpiece 3 is then rotated through an angle of 90° from vertical as shown in FIGS. 7 & 6, so that the appropriate face of the centerpiece 3 is directed upward. Pin 2 moves along the sides of holes 10 and 11 which contain points 20 and 21. To conclude the conversion process, pin 2 slides into notches 16 and 17 when tabs 14 and 15 reach the innermost points of channels 6 and 7, securing centerpiece 3 in the required position as in FIG. 6 for use as a finger-ring. The centerpiece 3 is further secured by sliding the device onto a finger or thumb, the finger or thumb thus forming an axis for the ring.

Figure 10:
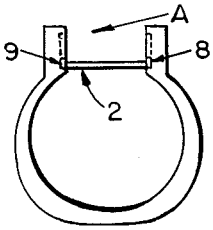
FIG. 10 is a front elevation of a ring-band made in accordance with the principles of the present invention.
Figure 11:
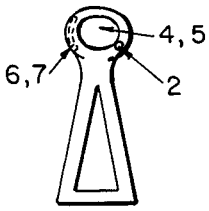
FIG. 11 is a side elevation of the same ring-band as shown in FIG. 10.
Figure 12:
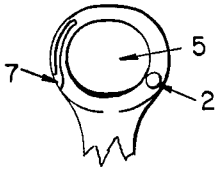
FIG. 12 is an enlarged cutaway view of one of the channels at the ends of the ring-band shown in FIGS. 10 and 11.

Specific details of the locking mechanism are further provided in FIGS. 10 through 12. FIG. 10 shows the ring-band 1*c* with pin 2 permanently fixed between the ends of the band at points 8 and 9. FIG. 11 shows the location of channels 6 and 7 and pin 2 relative to holes 4 and 5, said holes being used for the insertion of a chain (not shown) during use as a pendant. FIG. 12 shows an enlarged view of hole 5, illustrating the shape and orientation of channel 7.

I claim:

1. An interconvertible ring-pendant, comprising:

(a) a generally U-shaped member including a first pair of openings in the end of each U-shaped portion (b) a transverse pin member spanning the ends of the U-shaped member and extending through a pair of second openings offset from said first openings formed in the ends of said U-shaped member;

(c) an ornamental centerpiece having an elongated opening at one end rotatably suspended from the transverse member;

(d) means for limiting rotation of the centerpiece about the transverse member, said limiting means including;

(e) first and second tabs on opposite sides of the centerpiece;

(f) first and second arcuate channels on opposite sides of the U-shaped member for guiding the first and second tabs, respectively, during the process of converting the ring-pendant from the ring configuration to the pendant configuration, and from the pendant configuration to the ring configuration;

(g) first and second notches on opposite sides of the centerpiece, for receiving the member after rotation about the transverse member and for preventing further rotation of the centerpiece about the transverse member; and (h) said first openings and said elongated opening being adapted to receive a chain to form a pendant on a necklace.

* * * * *